US007361054B2

(12) United States Patent
Kuo

(10) Patent No.: US 7,361,054 B2
(45) Date of Patent: Apr. 22, 2008

(54) CONNECTOR ASSEMBLY WITH BRACKET

(75) Inventor: Peter Kuo, Tu-cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/634,537

(22) Filed: Dec. 6, 2006

(65) Prior Publication Data

US 2007/0128938 A1 Jun. 7, 2007

(30) Foreign Application Priority Data

Dec. 6, 2005 (CN) ..... 2005 2 0139529

(51) Int. Cl.
*H01R 13/648* (2006.01)

(52) U.S. Cl. ..... 439/607; 439/557

(58) Field of Classification Search ..... 439/607, 439/604, 557, 939
See application file for complete search history.

(56) References Cited

U.S. PATENT DOCUMENTS

| | | | | |
|---|---|---|---|---|
| 3,339,050 | A | 8/1967 | Mitchell | |
| 4,501,459 | A * | 2/1985 | Chandler et al. | 439/295 |
| 4,947,010 | A | 8/1990 | Heydner | |
| 5,037,325 | A * | 8/1991 | Wirkus | 439/467 |
| 5,277,623 | A | 1/1994 | Colleran | |
| 5,397,246 | A * | 3/1995 | Defibaugh et al. | 439/352 |
| 5,599,207 | A * | 2/1997 | Lai | 439/567 |
| 5,613,876 | A | 3/1997 | Sakatani | |
| 5,709,569 | A * | 1/1998 | Buck et al. | 439/607 |
| 5,772,471 | A * | 6/1998 | Buck | 439/607 |
| 5,895,289 | A * | 4/1999 | Smith | 439/553 |
| 6,089,909 | A * | 7/2000 | Tokuwa | 439/557 |
| 6,206,730 | B1 * | 3/2001 | Avery et al. | 439/609 |
| 6,210,217 | B1 | 4/2001 | Ping | |
| 6,231,384 | B1 * | 5/2001 | Kuo | 439/545 |
| 6,231,385 | B1 * | 5/2001 | Kuo | 439/557 |
| 6,238,242 | B1 * | 5/2001 | Hwang | 439/545 |
| 6,679,726 | B1 * | 1/2004 | Tunn et al. | 439/565 |
| 6,709,286 | B1 * | 3/2004 | Korsunsky et al. | 439/557 |
| 6,991,494 | B1 * | 1/2006 | Spink, Jr. | 439/607 |
| 7,094,099 | B2 * | 8/2006 | Daggett et al. | 439/567 |
| 7,168,987 | B1 * | 1/2007 | Morohoshi et al. | 438/608 |
| 2004/0242036 | A1 * | 12/2004 | Schempp | 439/108 |

* cited by examiner

*Primary Examiner*—Tulsidas C. Patel
*Assistant Examiner*—Vladimir Imas
(74) *Attorney, Agent, or Firm*—Wei Te Chung

(57) ABSTRACT

A connector assembly includes an insulative housing adapted for mating with a complementary connector, a conductive shell shrouding the insulative housing and comprising a front opening adapted for receiving the complementary connector and a flange adjacent to said front opening and extending outwards to be away from the front opening, and a conductive bracket comprising an opening communicating with the front opening of the conductive shell in the center thereof, a wing plate located in the periphery and a fixation plate connecting the opening and the wing plate. The fixation plate abuts against and is soldered with said flange of the conductive shell. When the connector assembly is mounted on the panel, said wing plate abuts against the panel.

16 Claims, 8 Drawing Sheets

CONNECTOR ASSEMBLY WITH BRACKET

BACKGROUND OF THE INVENTION

1. Field of the Invention

This invention generally relates to a connector assembly, and more particularly, to a connector assembly mounted to a panel.

2. Description of the Prior Art

Auxiliary fastening devices, such as screws, are normally used to mount an electrical connector to a panel, but these make the assembly or disassembly process troublesome.

An electrical connector which has a fastening attachment is desired to meet the requirements of mass production. Such an electrical connector is shown in FIG. 7. The electrical connector 50 comprises an elongated insulative housing 501 and a fastening portion 502 projecting rearwardly from the insulative housing 501. A pair of fixing wings 503 respectively depends from opposite top and bottom edges of the fastening portion 502. A retaining portion 504 outwardly extends from a distal end of each fixing wing 503, forming a pair of spaces 505 within the acute angles defined by the fixing wings 503 and the retaining portions 504. A projection 507 extends outwardly from an inward edge of each slit 506. In assembly, an upper edge 512 and a lower edge 513 of a slot 511 in a conductive panel 51 are respectively secured in the angle spaces 504 between the fixing wings 503 and the retaining portions 504. However, the fixing wings 503 and the projections 507 are complex in structure and difficult to be manufactured, so the design of the electrical connector is not appropriate for inexpensive mass production. Furthermore, the electrical connector can not be conveniently assembled or dissembled, and the projections 507 are easily abraded over time, so that a reliable attachment between the electrical connector and the panel can not be attained. Additionally, the projections 507 are vulnerable to being damaged by strong insertion forces.

U.S. Pat. No. 6,210,217 discloses an electrical connector system (shown in FIG. 8) which comprises an insulative housing, a shell 102 enclosing the insulative housing, and a conductive panel 15 defining a mating slot 151 therein. After the rear end of both the insulative housing and the shell 102 pass through the mating slot 151, a plurality of flanges 105 integral with and locating in the front of the shell 102 engage with inner edges 154, 155 of the front side of the panel 15. At the same time, a spring finger 107 formed in the rear end of the shell 102 abuts against the rear side of the panel 15, thereby mounting the shell 102 onto the panel 15. Structures fitting in with the panel 15 are integrally formed with the shell 102, so they are excrescent when the connector system isn't used to connect a panel.

Hence, an improved connector assembly is desired to overcome the above problems and meet the increasing demand.

BRIEF SUMMARY OF THE INVENTION

It is an object of the present invention to provide a connector assembly with a bracket for connecting a panel.

In order to attain the object above, a connector assembly according to the present invention comprises an insulative housing adapted for mating with a complementary connector, a conductive shell shrouding the insulative housing and comprising a front opening adapted for receiving the complementary connector and a flange adjacent to said front opening and extending outwards to be away from the front opening, and a conductive bracket comprising an opening communicating with the front opening of the conductive shell in the center thereof, a wing plate located in the periphery and a fixation plate connecting the opening and the wing plate. The fixation plate abuts against and is soldered with said flange of the conductive shell. When the connector assembly is mounted on the panel, said wing plate abuts against the panel.

Other objects, advantages and novel features of the invention will become more apparent from the following detailed description of the present embodiment when taken in conjunction with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE INVENTION

Figure 1:
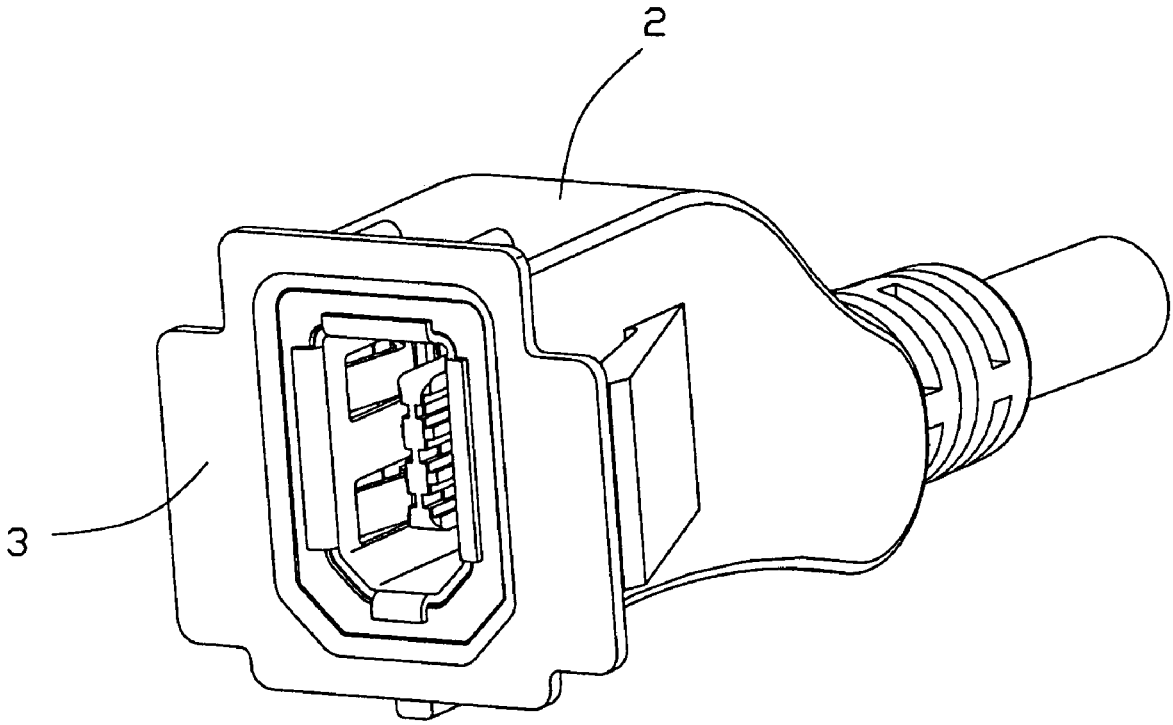
FIG. 1 is an assembled view of a connector assembly in accordance with the present invention.
Figure 2:
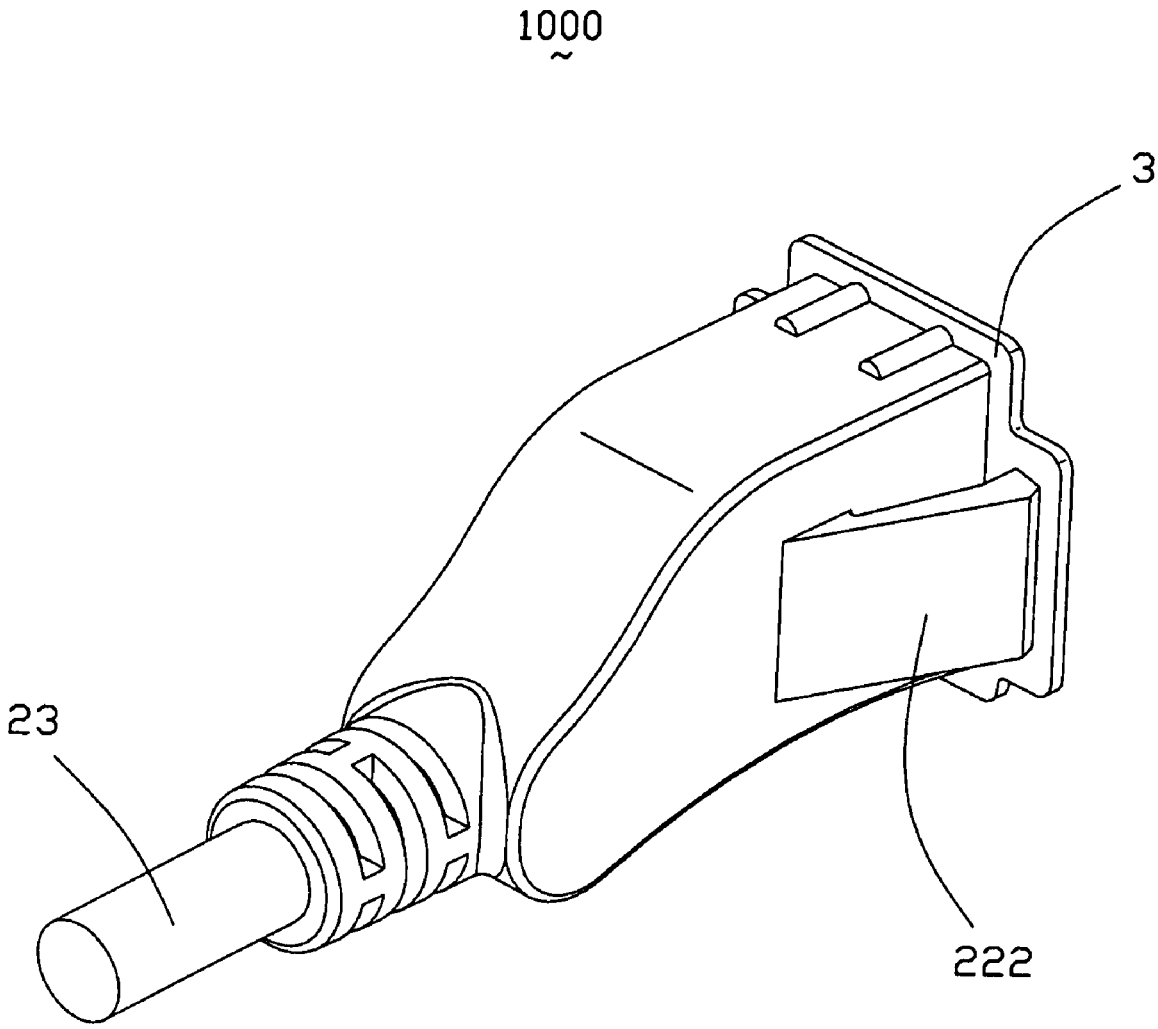
FIG. 2 is a view similar to FIG. 1, but viewed from another aspect.

Reference will now be made in detail to the preferred embodiment of the present invention.

As shown in FIGS. 1-4, a connector assembly 1000 according to the present invention comprises a connector module 2 and a bracket 3 mounted on the connector module 2. The connector module 2 comprises a connector 20, a cable set 23 electrically connecting the connector 20 and covers 21, 22 shrouding both the connector 20 and the cable set 23.

Figure 5:
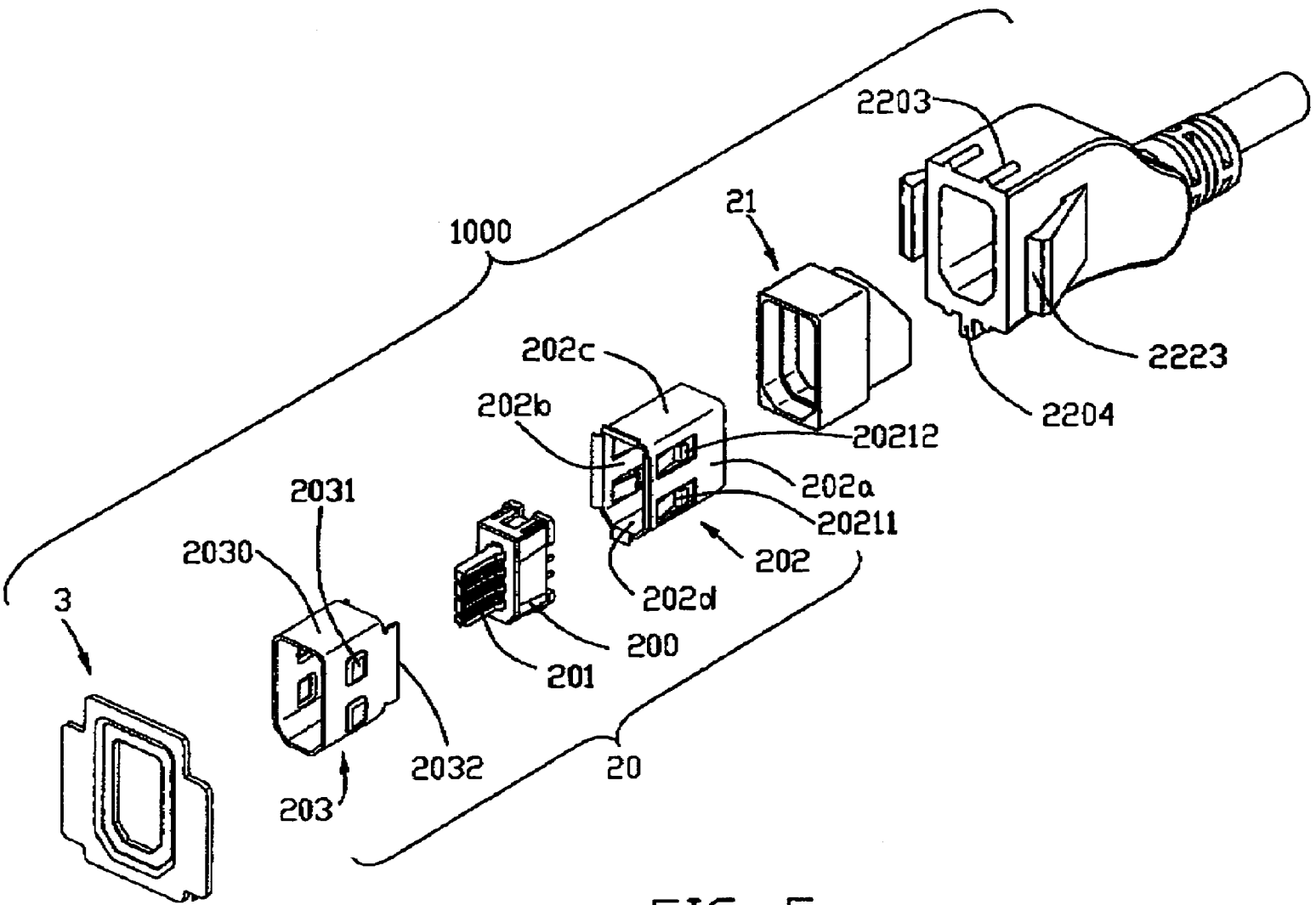
FIG. 5 is an adequately exploded view of the connector assembly shown in FIG. 1.
Figure 6:
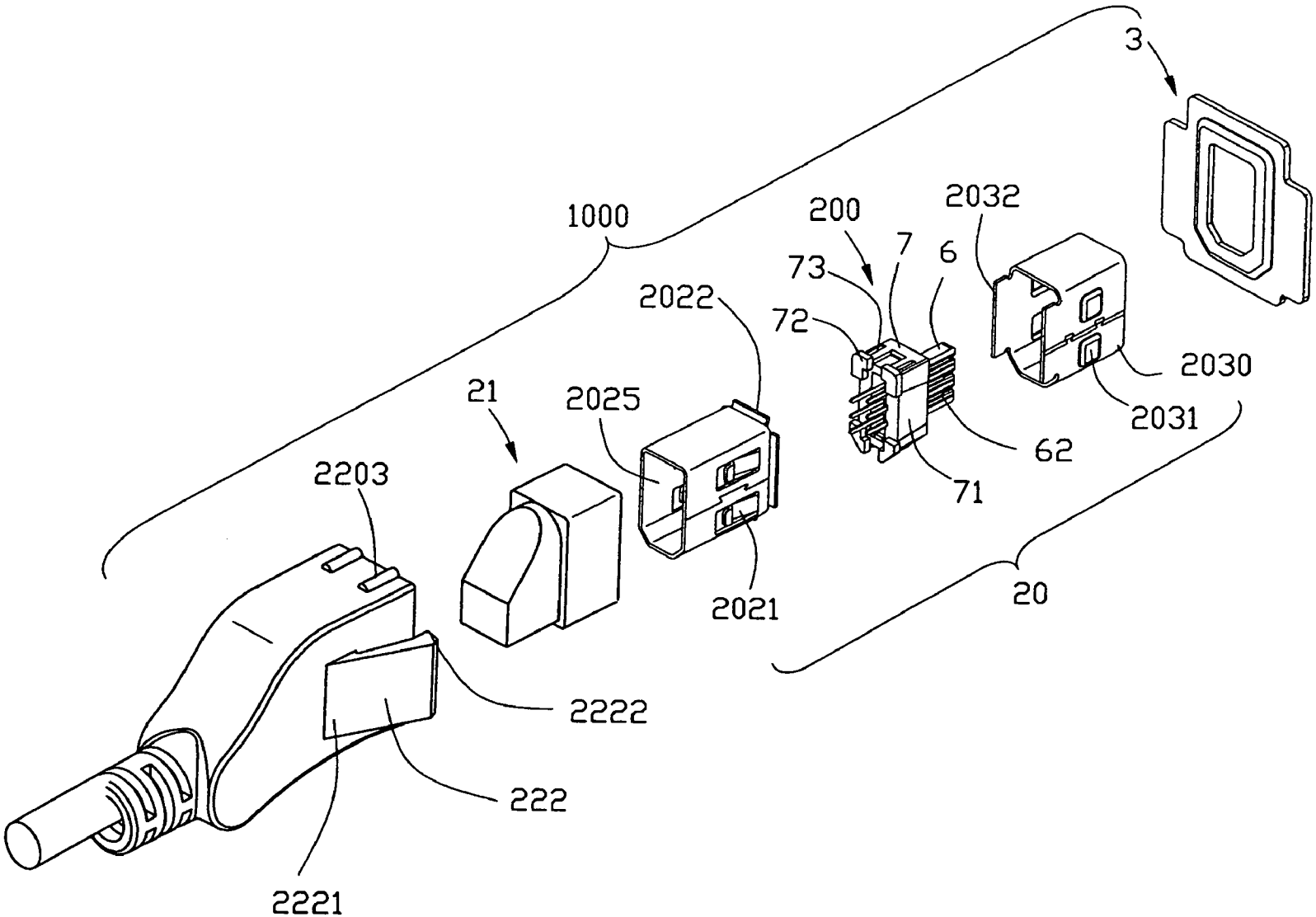
FIG. 6 is a view similar to FIG. 5, but viewed from another aspect.

As shown in FIGS. 5-6, the connector 20 has an insulative housing 200, a plurality of conductive terminals 201 held in the housing 200, a first shell 202 shielding the housing 200 and a second shell 203 surrounding the first shell 202. The covers 21, 22 have an inner insulator 21 and an outer cover 22.

The housing 200 has a base 7 and a tongue portion 6 forwards extending from the base 7. A pair of recesses 71 are formed on lateral sides of the base 7. Four flanges 72 are formed on the rear surface of the base 7 and extend outwards therefrom. A plurality of bars 73 are formed on the upper and lower surfaces of the base 7. The tongue portion 6 defines a plurality of slots 62 thereon. A plurality of conductive terminals 201 are held in the slots 62.

The first shell 202 is preferably stamped and pressed from a metal sheet and has a left wall 202*a*, a right wall 202*b*, a top wall 202*c* and a bottom wall 202*d* connected together and defining a front opening 2024 and a rear opening 2025 therebetween. A pair of resilient anus 2021 are formed in each left and right wall 202*a*, 202*b*. Each and 2021 defines an innermost contacting apex 20211 extending towards the tongue portion 6 and a free distal end 20212 extending outwardly from the innermost contacting apex 20211. An outwards protruding flange 2022 extends from each wall 202*a*, 202*b*, 202*c*, 202*d* from a periphery of the front opening 2024.

The second shell 203 is preferably stamped and pressed from a metal sheet and has a base 2030, a front opening (not labeled) and a rear opening (not labeled). A pair of window portions 2031 are formed in each left and right wall and extend outwards therefrom, thereby receiving the resilient arms 2021 of the first shell 202. A pair of spring pieces 2032 extend rearwards from the rear ends of the left and right wall of the base 2030.

Now referring to FIGS. 3-6, in assembly, the housing 200 receiving the terminals 201 is inserted into the first shell 202 along the back-to-front direction till the flanges 72 of the housing 200 abut against the rear surface of the first shell 202. At the same time, the bars 73 of the base 7 abut against the inner surface of the first shell 202 to increase the retention force between the housing 200 and the first shell 202. Secondly, the first shell 202 holding the housing 200 therein is inserted into the second shell 203 along a front-to-back direction with the flanges 2022 of the first shell 202 engaging with the front surface of the second shell 203. Now the connector 20 is completed.

The bracket 3 is made of metal and flat in principle. The bracket 3 comprises an opening 32 in the middle, two pairs of wing plates 31 in the peripheries and a fixation plate 33 thinner than the wing plates 31 and connecting the opening 32 and wing plates 31. The opening 32 is shaped similar to the front opening 2024 of the first shell 202 and wide enough to receive the whole connector 20 excluding the outer protruding flanges 2022.

Figure 3:
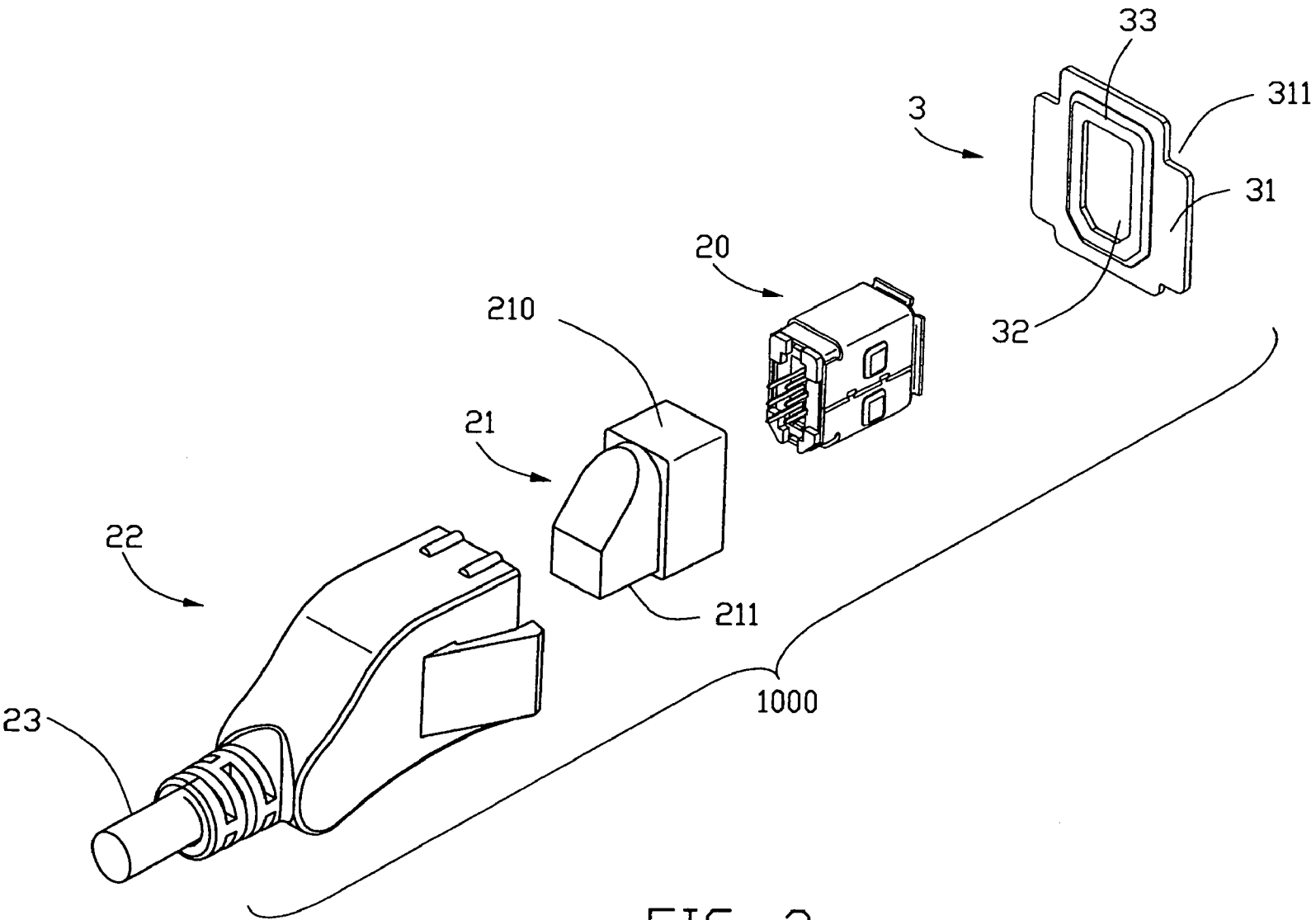
FIG. 3 is a partially, exploded view of the connector assembly shown in FIG. 1.
Figure 4:
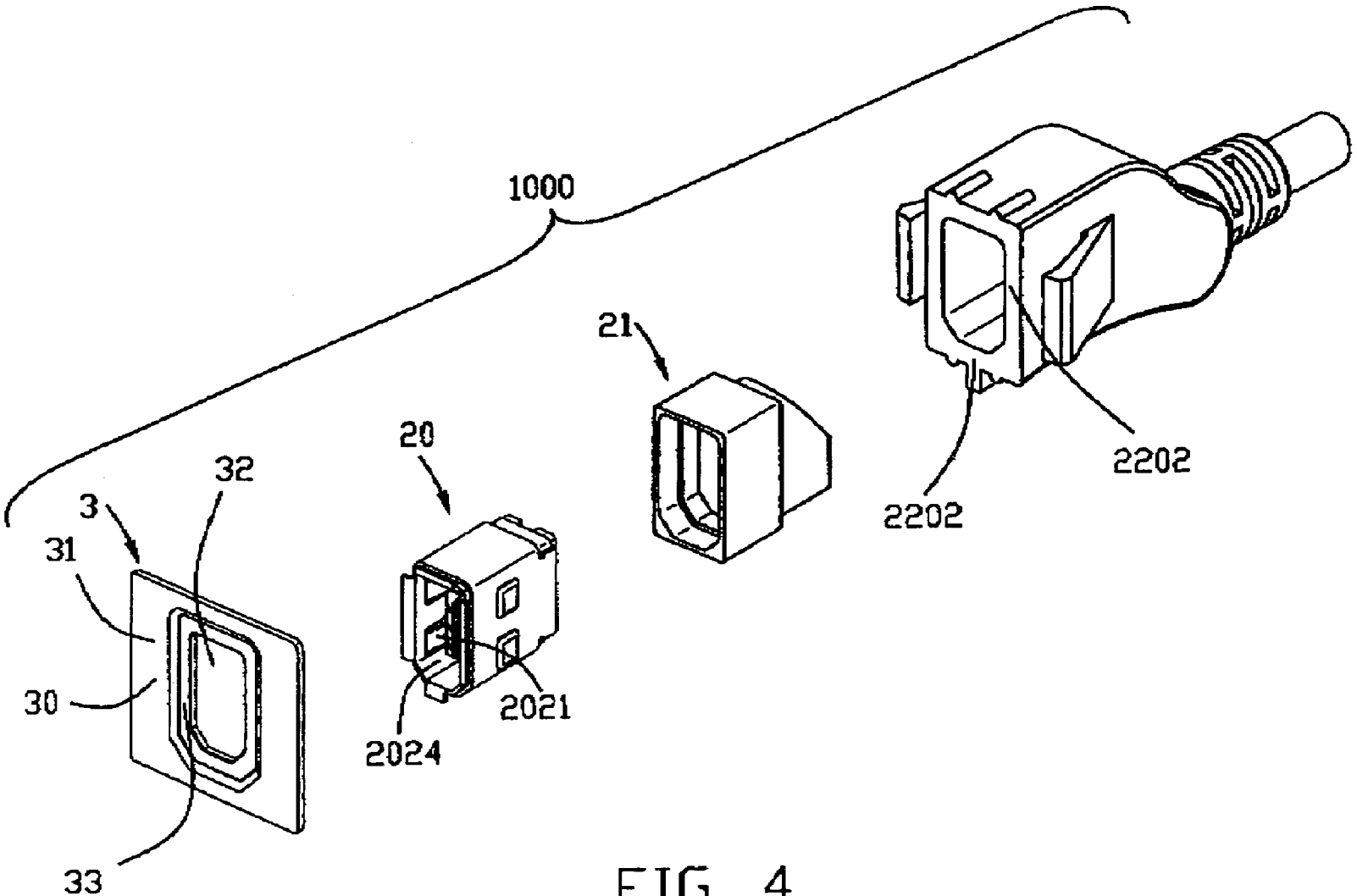
FIG. 4 is a view similar to FIG. 3, but with a different bracket and viewed from another aspect.

Referring to FIG. 3, the wing plates 31 are spaced from each other by four spaces 311. Of course, the spaces 311 can be removed and all the wing plates 31 will become a continuous plate (shown in FIG. 4).

In assembly, the connector 20 is inserted into the bracket 3 along a front-to-back direction and the outwards protruding flanges 2022 of the first shell 202 abut against and are soldered with the fixation plates 33. Secondly, core wires (not shown) of the cable set 23 are soldered with the rear end of the conductive terminals 201 held in the connector 20. Thirdly, an inner insulator 21 is over-molded on both the connector 20 and the front end of the cable set 23. The inner insulator 21 comprises a base 210 receiving the rear end of the connector 20 and a wire receiving portion 211 extending rearwards from the base 210 and shrouding the cable set 23.

Figure 7:
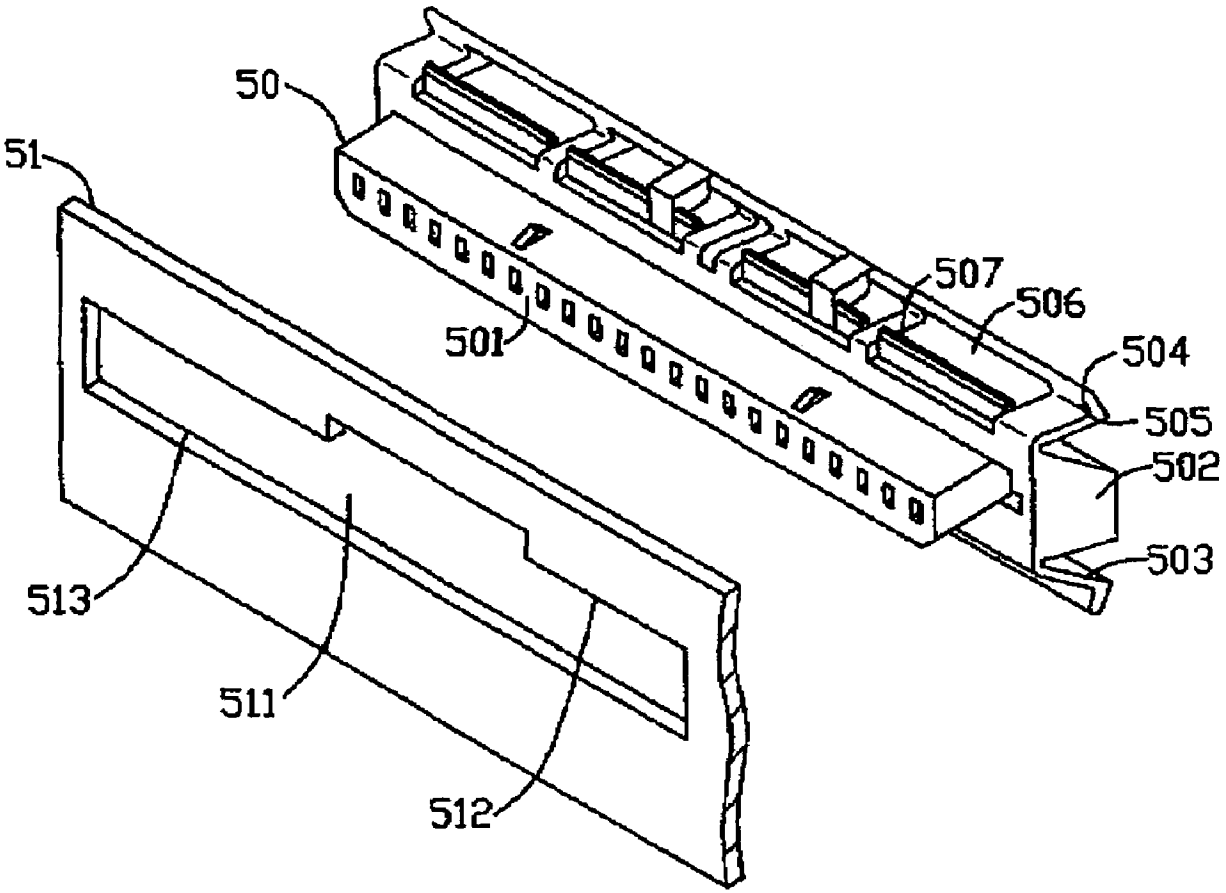
FIG. 7 (PRIOR ART)
FIG. 7 is an assembly view of a conventional electrical connector.
Figure 8:
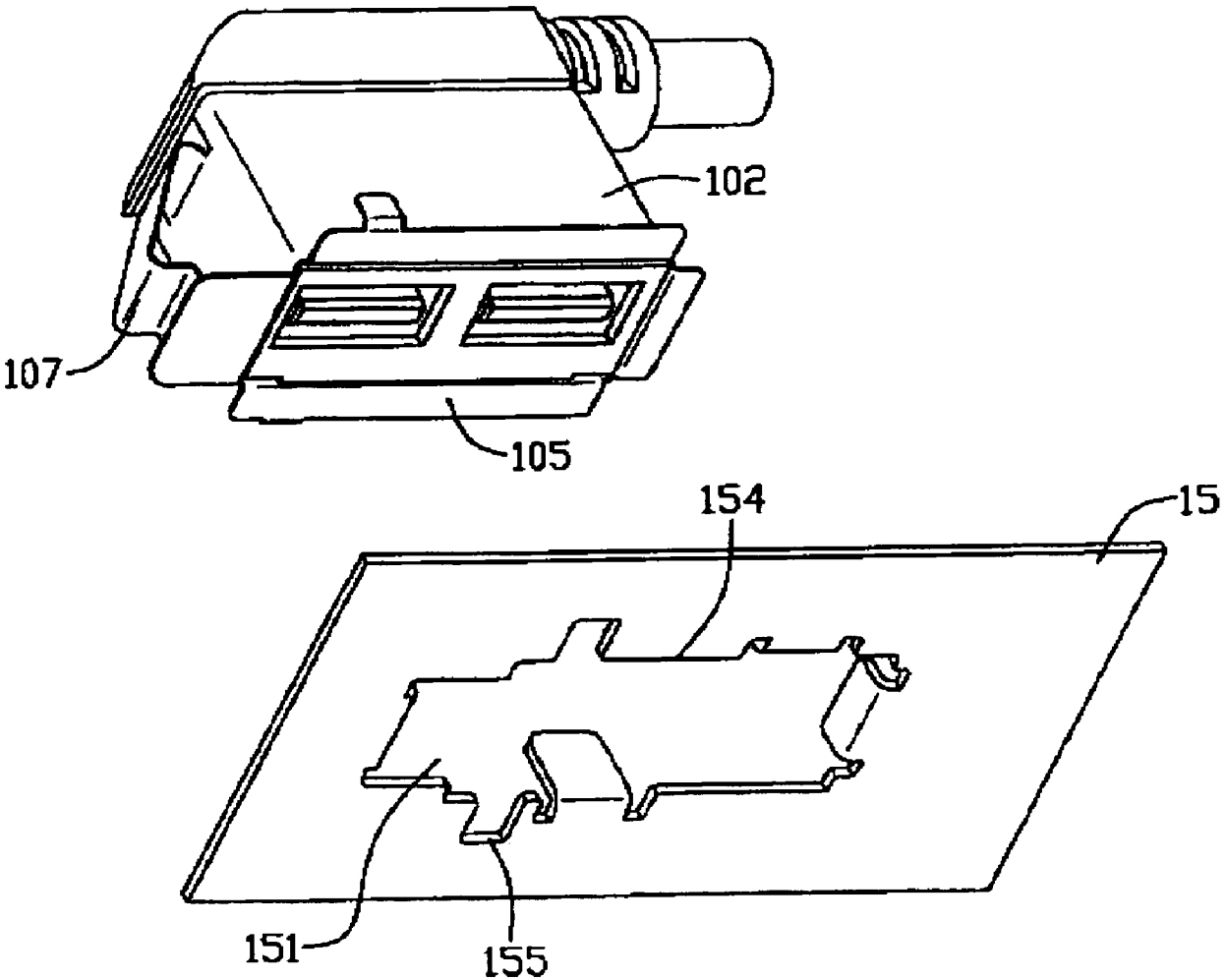
FIG. 8 (PRIOR ART)
FIG. 8 is an assembly view of another conventional electrical connector system.

Fourthly, an outer cover 22 is over-molded to shroud the connector 20, the inner insulator 21 and the cable set 23. The edges 2202 of the front surface of the outer cover 22 abut against the rear surface of the bracket 3 in order to fasten the bracket 3. Two pairs of bars 2203 are projected on the top and bottom walls of the outer cover 22 and extend along a front-to-back direction from the front surface of the outer cover 22, thereby abutting against the rear surface of the bracket 3 and engaging with inner sides of a panel (not shown, but similar to the panel 51 in FIG. 7) when the connector assembly 1000 is mounted onto the panel. A larger bar 2204 is located between the pair of bars 2203 on the bottom wall of the outer cover 22, thereby preventing the connector assembly 1000 from a mistake engaging with the panel (not shown).

The outer cover 22 further comprises a pair of movable locking members 222 on the left and right walls. Each movable locking member 2222 comprises a connecting portion 2221 connecting the left or right wall of the outer cover 22 and a rotating portion 2222 rotatable around on the connecting portion 2221. The front surface of the rotating portion 2222 is an inclined surface 2223. In an original status, the front portion of the inclined surface 2223 abuts against the rear surface of the bracket 3. When the connector assembly 1000 is needed to mounted onto a panel, rotate inwards the rotating portions 2222, and the front portion of the inclined surface 2223 get away from the bracket 3. At the same time, a space (not shown) is formed therebetween to receive the panel (not shown) which engages with the connector assembly 1000 along a back-to-front direction. Additionally, the rotating portions 2222 being rotated inwards can decrease the width of the connector assembly 1000 to make the assembly 1000 to pass through the panel. When the panel is in said space between the bracket 3 and the movable locking members 222, release the movable locking member 222 and the movable locking member 222 can automatically come back to the original status to fasten the panel.

When the connector assembly 1000 isn't applied to be mounted onto a panel, you just need to remember not to mount the bracket 3 onto the connector assembly 1000 and the connector assembly 1000 can also do a good work.

It is to be understood, however, that even though numerous, characteristics and advantages of the present invention have been set fourth in the foregoing description, together with details of the structure and function of the invention, the disclosed is illustrative only, and changes may be made in detail, especially in matters of number, shape, size, and arrangement of parts within the principles of the invention to the full extent indicated by the broad general meaning of the terms in which the appended claims are expressed.

What is claimed is:

1. A connector assembly adapted for being mounted onto a panel, comprising:

an insulative housing adapted for mating with a complementary connector;

a conductive shell shrouding the insulative housing and comprising a front opening adapted for receiving the complementary connector and a flange adjacent to said front opening and extending outwards to be away from the front opening; and a conductive bracket comprising an opening communicating with the front opening of the conductive shell in the center thereof, a wing plate located in the periphery and a fixation plate connecting the opening and the wing plate, said fixation plate and said wing plate standing in the same surface;

wherein said conductive shell is inserted into said opening of the conductive bracket along a rear-to-front direction till a rear surface of said flange abuts against a front surface of said fixation plate of the bracket, and then said shell and said bracket are soldered together;

wherein said wing plate lies at outermost of the connector assembly to position and hold the connector assembly on said panel in the help of a locking member of the connector assembly.

2. The connector assembly according to claim 1, wherein the fixation plate is thinner than the wing plate to form a space to receive the flange of the conductive shell.

3. The connector assembly according to claim 1, wherein the conductive shell further comprises a top wall, a bottom wall, a left wall and a right wall connected together and defining said front opening, and said flange is integrally formed with said walls.

4. The connector assembly according to claim 1, wherein a cover is over-molded and shrouds the conductive shell, and edges of the front surface of the cover abut against the rear surface of the bracket.

5. The connector assembly according to claim 4, wherein a plurality of bars are projected on some walls of the cover and extend along a front-to-back direction, thereby engaging with inner sides of a panel when the connector assembly is mounted onto the panel.

6. The connector assembly according to claim 5, wherein a larger bar is located on one wall of the cover for preventing the connector assembly from a mistake engaging with the panel.

7. The connector assembly according to claim 4, wherein said cover further comprises a movable locking member having a connecting portion connecting the cover and a rotating portion rotatable around on the connecting portion.

8. The connector assembly according to claim 7, wherein the front surface of the rotating portion is an inclined surface.

9. The connector assembly according to claim 4, wherein a cable electrically connects the rear end of the housing, and an inner insulator is over-molded on both the rear end of the shell and the front end of the cable, and said insulator is surrounded by said cover.

10. The connector assembly according to claim 3, wherein the connector assembly further comprises a second shell shielding said shell integrally formed with said wing plate.

11. An electrical connector assembly comprising:

an insulative housing;

a plurality of contacts disposed in the housing;

a metallic inner shell enclosing said housing and cooperating with the housing to define a mating port into which the contacts extend;

at least one cantilever type curved deflectable tang unitarily extending from an opening in either a top wall or a bottom wall of the inner shell via a stamping procedure wherein said deflectable tang defines an innermost contacting apex extending into the mating port and a free distal end extending outwardly from said innermost contacting apex; and a metallic outer shell directly circumferentially engaging and enclosing said inner shell, said outer shell essentially defining a complete circumferential shielding without openings in faces thereof corresponding said top wall and said bottom wall; wherein the outer shell defines an outwardly bulged portion in lateral alignment with the distal end of the deflectable tang so as to form a recess corresponding to receive the distal end when said deflectable tang is outwardly deflected by a mated complementary connector which is inserted into the mating port.

12. The electrical connector assembly as claimed in claim 11, wherein the inner shell defines a curved flare which is soldered around a mating opening of a metal bracket wherein the mating opening is aligned with the mating port.

13. The electrical connector assembly as claimed in claim 12, further including a metal panel with a mounting opening aligning with the mating opening of the metallic bracket, wherein the metallic bracket is located inside of the metal panel and the housing is located outside of the metal panel.

14. An electrical connector assembly comprising:

an insulative housing;

a plurality of contacts disposed in the housing;

a metallic inner shell enclosing said housing and cooperating with the housing to define a mating port into which the contacts extend;

at least one cantilever type curved deflectable tang unitarily extending from an opening in either a top wall of a bottom wall or the inner shell via a stamping procedure wherein said deflectable tang defines an innermost contacting apex extending into the mating port and a free distal end extending outwardly from said innermost contacting apex; and a metallic outer shell directly circumferentially engaging and enclosing said inner shell; wherein the outer shell defines a window portion in lateral alignment with the distal end of the deflectable tang so as to form a recess corresponding to receive the distal end when said deflectable tang is outwardly deflected by a mated complementary connector which is inserted into the mating port.

15. The electrical connector assembly as claimed in claim 14, wherein the inner shell defines a curved flare which is soldered around a mating opening of a metal bracket wherein the mating opening is aligned with the mating port.

16. The electrical connector assembly as claimed in claim 15, further including a metal panel with a mounting opening aligning with the mating opening of the metallic bracket, wherein the metallic bracket is located inside of the metal panel and the housing is located outside of the metal panel.

* * * * *